US011288950B2

(12) United States Patent
Venditti

(10) Patent No.: US 11,288,950 B2
(45) Date of Patent: Mar. 29, 2022

(54) MONITOR FOR AND/OR MONITORING A BATTERY POWERED WIRELESS ALARM DEVICE

(71) Applicant: KONINKLIJKE PHILIPS N.V., Eindhoven (NL)

(72) Inventor: Robert A. Venditti, Needham, MA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/253,519

(22) PCT Filed: Jun. 24, 2019

(86) PCT No.: PCT/EP2019/066569

§ 371 (c)(1),
(2) Date: Dec. 17, 2020

(87) PCT Pub. No.: WO2020/002173

PCT Pub. Date: Jan. 2, 2020

(65) Prior Publication Data

US 2021/0264768 A1 Aug. 26, 2021

Related U.S. Application Data

(60) Provisional application No. 62/691,654, filed on Jun. 29, 2018.

(51) Int. Cl.

| | |
|---|---|
| ***G08B 29/04*** | (2006.01) |
| ***G08B 29/18*** | (2006.01) |
| ***G08C 17/02*** | (2006.01) |

(52) U.S. Cl.

CPC ..... *G08B 29/04* (2013.01); *G08B 29/18* (2013.01); *G08B 29/181* (2013.01); *G08C 17/02* (2013.01)

(58) Field of Classification Search

CPC ..... G08B 29/04; G08B 29/181; G08B 29/18; G08C 17/02

(Continued)

(56) References Cited

U.S. PATENT DOCUMENTS 5,686,896 A 11/1997 Bergman
5,905,438 A 5/1999 Weiss et al.

(Continued)

FOREIGN PATENT DOCUMENTS

CN 201892717 U 7/2011
CN 203204810 U 9/2013

(Continued)

OTHER PUBLICATIONS

International Search Report and Written Opinion, International Application No. PCT/EP2019/066569, dated Sep. 18, 2019.

*Primary Examiner* — John A Tweel, Jr.

(57) ABSTRACT

A system (302) includes a battery powered wireless alert device ($\mathbf{304}_1, \ldots, \mathbf{304}_1, \ldots, \mathbf{304}_N$) and a battery powered wireless alert device monitor ($\mathbf{306}_1, \ldots, \mathbf{306}_1, \ldots, \mathbf{306}_N$). The battery powered wireless alert device includes electronic circuitry ($\mathbf{202}_1$), a transmitter ($\mathbf{204}_1$) configured to transmit a signal at a predetermined first rate to an alarm device (110), a logic circuit ($\mathbf{402}_1$) configured to generate an output signal at a predetermined second rate, wherein the first rate is lower than the second rate, and a power source ($\mathbf{206}_1$) configured to supply power to at least the electronic circuitry and the logic circuit. The battery powered wireless alert device monitor includes monitoring circuitry ($\mathbf{404}_1$) configured to monitor a health state of the battery powered wireless alert device based on the logic level, a transmitter ($\mathbf{204}_1$) configured to transmit a battery powered wireless alert device failure signal, on-demand, to the alarm device in response to the monitoring circuitry determining the logic level fails to satisfy predetermined criteria.

20 Claims, 6 Drawing Sheets

(58) Field of Classification Search
USPC ..... 340/506
See application file for complete search history.

(56) References Cited

U.S. PATENT DOCUMENTS

| | | | | |
|---|---|---|---|---|
| 7,295,133 | B1 | 11/2007 | McCollough, Jr. | |
| 8,519,566 | B2 * | 8/2013 | Recker | H02J 7/0068 307/64 |
| 10,033,208 | B2 * | 7/2018 | Blackwell | H02J 7/0047 |
| 2006/0135178 | A1 * | 6/2006 | Allyn | G08B 21/023 455/456.2 |
| 2009/0102672 | A1 * | 4/2009 | Petek | G08B 29/181 340/636.15 |

FOREIGN PATENT DOCUMENTS

| | | | |
|---|---|---|---|
| EP | 2051221 | A2 | 4/2009 |
| JP | 2009201249 | A | 9/2009 |
| WO | 2006091177 | A1 | 8/2006 |
| WO | 2017172972 | A1 | 10/2017 |

* cited by examiner

MONITOR FOR AND/OR MONITORING A BATTERY POWERED WIRELESS ALARM DEVICE

CROSS-REFERENCE TO PRIOR APPLICATIONS

This application is the U.S. National Phase application under 35 U.S.C. § 371 of International Application No. PCT/EP2019/066569, filed on 24 Jun. 2019, which claims the benefit of U.S. Provisional Patent Application No. 62/691,654, filed on 29 Jun. 2018. These applications are hereby incorporated by reference herein.

FIELD OF THE INVENTION

The following generally relates to a battery powered wireless alarm device and more particularly to a monitor configured to monitor a battery powered wireless alarm device and/or monitoring a battery powered wireless alarm device.

BACKGROUND OF THE INVENTION

FIG. 1 schematically illustrates an example alarm system 102. The alarm system 102 includes a plurality of alert devices 104, including at least one or more battery powered wireless alert (BPWA) devices $\mathbf{106}_1, \ldots, \mathbf{106}_N$ (collectively referred to herein as BPWA devices 106) where N is a positive integer equal to or greater than one. In this example, the plurality of alert devices 104 also includes one or more mains powered (i.e. general-purpose alternating current (AC), such as "wall" power) wireless alert (MPWA) devices $\mathbf{108}_1, \ldots, \mathbf{108}_M$ (collectively referred to herein as MPWA devices 108), where M is a positive integer equal to or greater than one. The alarm system 102 further includes at least one alarm system 110 with a receiver (RX) 112 and a transmitter (TX) 114.

In this example, at least one of the BPWA devices 106 is configured to monitor an event and issues an alert (e.g., audible, visual, etc.) if a predetermined condition is satisfied. For example, the at least one of the BPWA devices 106 can be part of and/or used with a medical device with a sensor that senses and records and/or reports a physiological state of a subject. In another example, the at least one of the BPWA devices 106 is part of a fall detection device that detects, and reports falls, a personal alarm device that allows a user to send an alert indicating they need help on demand, a burglar alarm, a fire alarm, a motion detector, a computer, and/or other device configured to detect an event. The MPWA devices 108 likewise can include these types of devices.

FIG. 2 schematically illustrates an example of one of the BPWA devices $\mathbf{106}_1, \ldots, \mathbf{106}_N$, namely, a BPWA device $\mathbf{106}_j$, where $1 \leq j \leq N$. The BPWA device $\mathbf{106}_j$ includes electronic circuitry $\mathbf{202}_j$ configured to at least generate status signals, a transmitter (TX) $\mathbf{204}_j$ configured to transmit a radio frequency signal to the alarm system 110, and a power source $\mathbf{206}_j$ configured to supply power for at least the electronic circuitry $\mathbf{202}_j$ and the transmitter $\mathbf{204}_j$. Suitable frequency bands include 896-901 megahertz (MHz) (e.g., 900 MHz), Wi-Fi and/or another Federal Communications Commission (FCC) mandated band. The power source $\mathbf{206}_j$ can be a primary (i.e. single-use or disposable) battery or a secondary (i.e. rechargeable) battery.

The BPWA device $\mathbf{106}_j$ is configured to periodically transmit the status signal to the alarm system 110. The status signal at least includes an indication of a health state of the BPWA device $\mathbf{106}_j$ (e.g., hardware failure, etc.) and/or the power source $\mathbf{206}_j$ (e.g., charge level, etc.) and, in one instance, a unique identification (UID) of the BPWA device $\mathbf{106}_j$, a location of the BPWA device $\mathbf{106}_j$, a type of equipment the BPWA device $\mathbf{106}_j$ is monitoring, and/or other information. The alarm system 110 monitors this status signal and notifies personnel if a predetermined condition is met. For example, the alarm system 110 may be configured to transmit an alert notification to a mobile device, a pager, a display screen, etc. when the status signal is not received within a predetermined time period, indicates a hardware failure, indicates a charge level that is below a predetermined threshold, etc. To maintain a long life of the power source $\mathbf{206}_j$, transmission of the status signal may be limited to only every hour or more. In this instance, a failure may not be detected by the alarm system 110 for up to an hour or more after the failure because the alarm system 110 will not detect absence of the status signal or receive a status signal indicating the failure until lapse or expiration of the predetermined time period. However, for some applications, the transmission rate must meet requirements outlined in a safety and performance standard. For example, for medical applications, the transmission rate must meet the requirements in Underwriters Laboratories UL 1069 (Standard for Hospital Signaling and Nurse Call Equipment) requirements.

To meet the UL 1069 standard, the BPWA device $\mathbf{106}_j$ would have to transmit status signals at a rate of at least once per ninety (90) seconds. Unfortunately, this would result in a significant shorter life of the power source $\mathbf{206}_j$ requiring more frequent power source $\mathbf{206}_j$ changes or charges, which may increase cost and decrease event monitoring time. This does not affect the MPWA devices 108, which are powered by mains power. Furthermore, the higher transmission rate would result in more RF traffic, and where several of the plurality of alert devices 104 (the BPWA devices 106 and/or the MPWA devices 108) are configured to satisfy the UL 1069 standard, the delivery of a status signal may be delayed due to the increased bandwidth consumption of limited bandwidth.

The following provides an example of how status signal transmission rate affects the lifetime of a battery. Where the BPWA device $\mathbf{106}_j$ consumes electrical current of 0.015 milliamperes (mA) per hour and is configured to transmit a status signal every 90 minutes, the status signal transmission consumes 35 mA of electrical current for a period of 25 milliseconds (ms) and is sent every 1.5 hours. Electrical current consumption for the status transmission can be calculated as: 35 mA*0.025 second/3,600 seconds per hour/1.5 hours=0.000162 milliampere-hours (mAh). The total current consumption rate is the current used by normal operation plus the current used by the status transmission, or 0.015 mAh+0.000162 mAh=0.015162 mAh. Where BPWA device $\mathbf{106}_j$ uses a 1400 mAh battery, the battery life can be calculated as: Battery capacity/current consumption per hour=1,400 mAh/0.015162 mAh=92,335.9 hours, or 10.5 years. Where the status signal is instead transmitted every 30 seconds, the electrical current consumption for the status transmission would be: 35 mA*0.025 second/3,600 seconds per hour/0.0083 hours=0.0292 mAh, the total current consumption would be: 0.015 mAh+0.0292 mAh=0.0442 mAh, and the battery life drops to: 1,400 mAh/0.0442 mAh=31,698.1 hours, or 3.62 years. Further increasing the transmission rate would further reduce battery life.

SUMMARY OF THE INVENTION

Aspects described herein address the above-referenced problems and others.

In one aspect, an alarm system includes a battery powered wireless alert device and a battery powered wireless alert device monitor. The battery powered wireless alert device includes electronic circuitry, a transmitter configured to transmit a signal at a predetermined first rate to an alarm device, a logic circuit configured to generate an output signal at a predetermined second rate, wherein the first rate is lower than the second rate, and a power source configured to supply power to at least the electronic circuitry and the logic circuit. The battery powered wireless alert device monitor includes monitoring circuitry configured to monitor a health state of the battery powered wireless alert device based on the logic level, a transmitter configured to transmit a battery powered wireless alert device failure signal, on-demand, to the alarm device in response to the monitoring circuitry determining the logic level fails to satisfy predetermined criteria.

In another aspect, a method includes transmitting, with a transmitter of a battery powered wireless alert device, a signal at a predetermined first rate to an alarm device and toggling, with a logic circuit of the battery powered wireless alert device, an output logic level between two logic levels at a predetermined second rate. The method further includes monitoring, with monitoring circuitry of a battery powered wireless alert device monitor, the toggling of the output logic level at the predetermined second rate, wherein the second rate is higher than the first rate, and transmitting, with a transmitter of the battery powered wireless alert device, a battery powered wireless alert device monitor failure signal, on-demand, in response to detecting the output logic level is not toggling within the second rate.

In another aspect, a method includes receiving, at an alarm device, a signal transmitted with a transmitter of a battery powered wireless alert device at a predetermined first rate. The method further includes receiving, at the alarm device, a battery powered wireless alert device failure signal transmitted with a transmitter of a battery powered wireless alert monitor device within a predetermined time period from detection by the battery powered wireless alert monitor device that the battery powered wireless alert device failed to toggle a logic level between two states within a predetermined second rate. The method further includes transmitting, with the alarm device, a notification signal indicating the battery powered wireless alert device failed.

The invention may take form in various components and arrangements of components, and in various steps and arrangements of steps. The drawings are only for purposes of illustrating the embodiments and are not to be construed as limiting the invention.

DETAILED DESCRIPTION OF EMBODIMENTS

Generally described herein is an approach that provides fast detection and reporting/notification of a device failure when using a battery operated wireless device while maintaining long battery life time and not using excessive bandwidth, and, optionally, mitigating blockage of failure signals due to frequency band interference.

Figure 1:
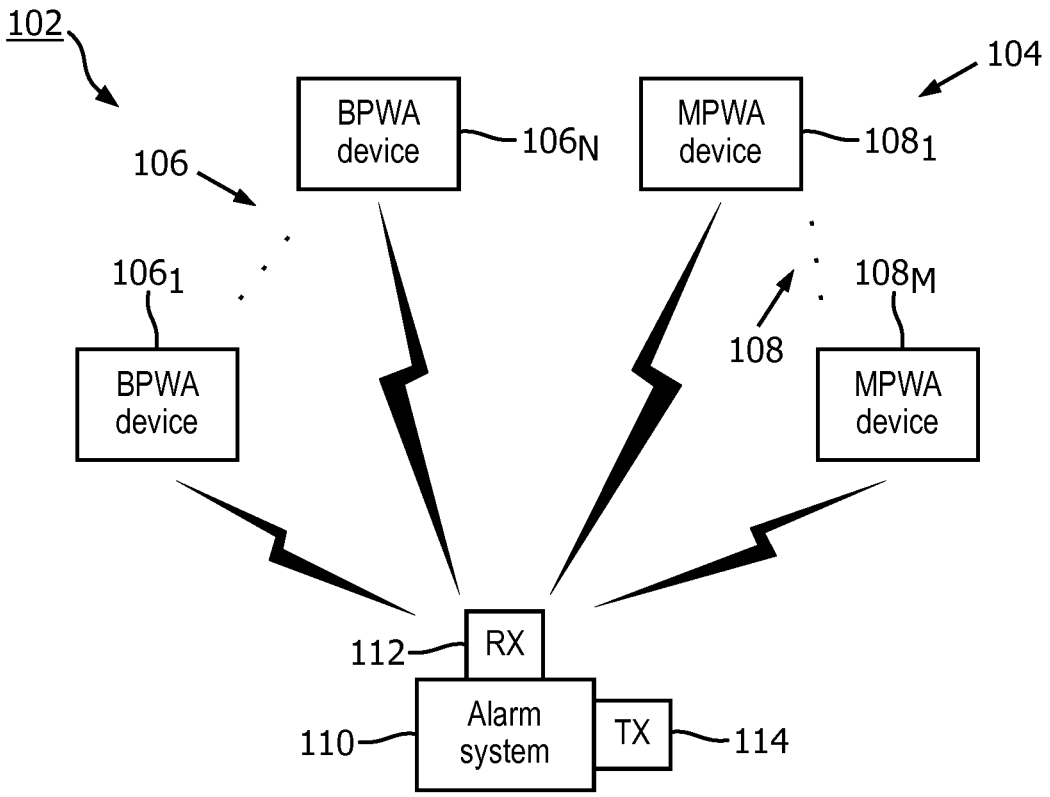
FIG. 1 (Prior art)
FIG. 1 schematically illustrates an example prior art alarm system with a battery powered wireless alert device and a mains powered wireless alert device.
Figure 3:
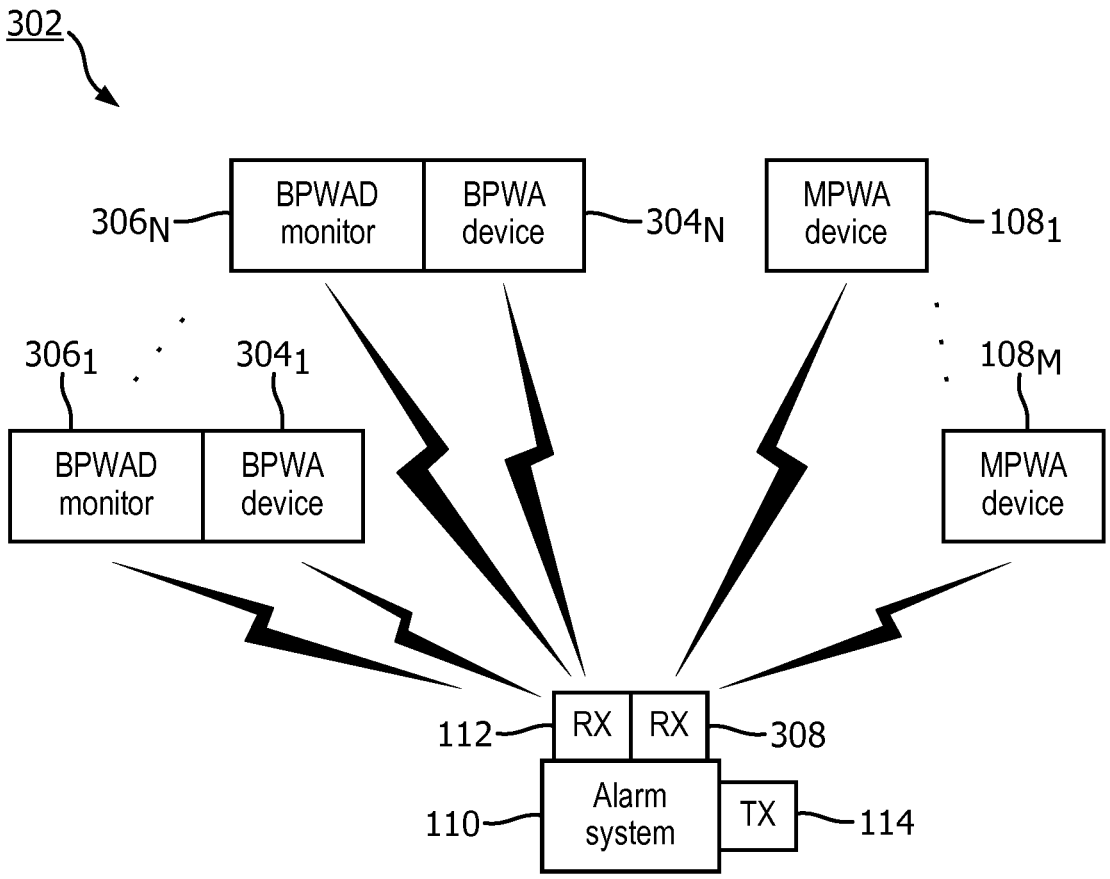
FIG. 3 schematically illustrates the alarm system with a battery powered wireless alert device monitor configured to monitor a health state of the battery powered wireless alert device, in accordance with an aspect of an embodiment(s) herein.

FIG. 3 schematically illustrates a system 302 with the MPWA devices $\mathbf{108}_1, \ldots, \mathbf{108}_M$, the alarm system 110, the receiver 112, and the transmitter 114 of FIG. 1. In another embodiment, the MPWA devices $\mathbf{108}_1, \ldots, \mathbf{108}_M$ are absent. The system 302 further includes one or more BPWA devices $\mathbf{304}_1, \ldots, \mathbf{304}_N$ and one or more BPWA device (BPWAD) monitors $\mathbf{306}_1, \ldots, \mathbf{306}_N$. Each of the BPWA device/BPWAD monitor pairs $\mathbf{304}_1/\mathbf{306}_1, \ldots, \mathbf{304}_M/\mathbf{306}_M$ can be a single entity (as shown in FIG. 3) or two separate and distinct entities in electrical communication with each other (as shown in FIG. 4) and a second receiver (RX) 308.

Figure 4:
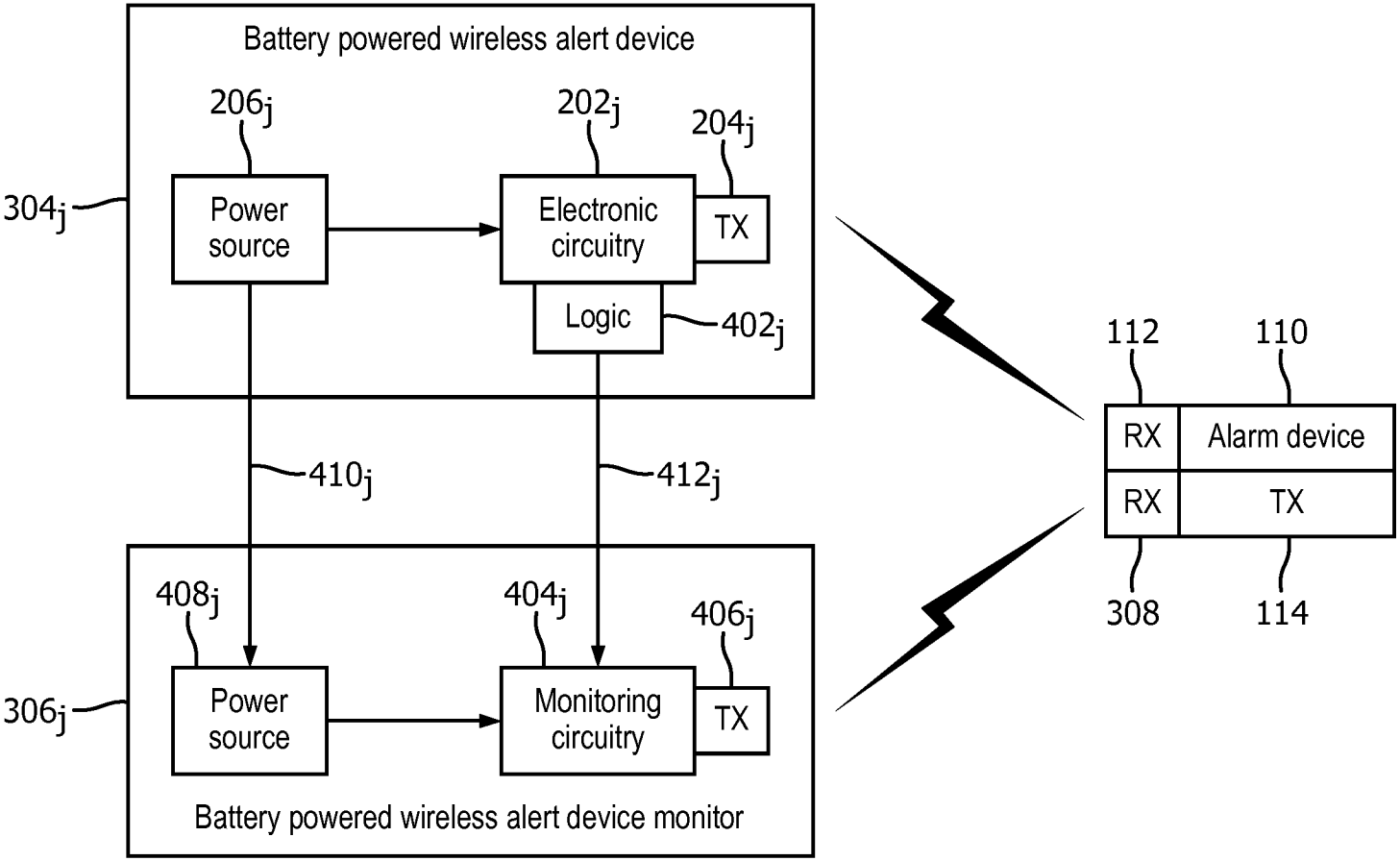
FIG. 4 schematically illustrates the battery powered wireless alert monitor in connection with the battery powered wireless alert device, in accordance with an aspect of an embodiment(s) herein.

FIG. 4 schematically illustrates an example of one of the BPWA devices $\mathbf{304}_1, \ldots, \mathbf{304}_N$ (a BPWA device $\mathbf{304}_j$) in connection with one of the BPWAD monitors $\mathbf{306}_1, \ldots, \mathbf{306}_N$ (namely, a BPWAD device $\mathbf{304}_j$).

Figure 2:
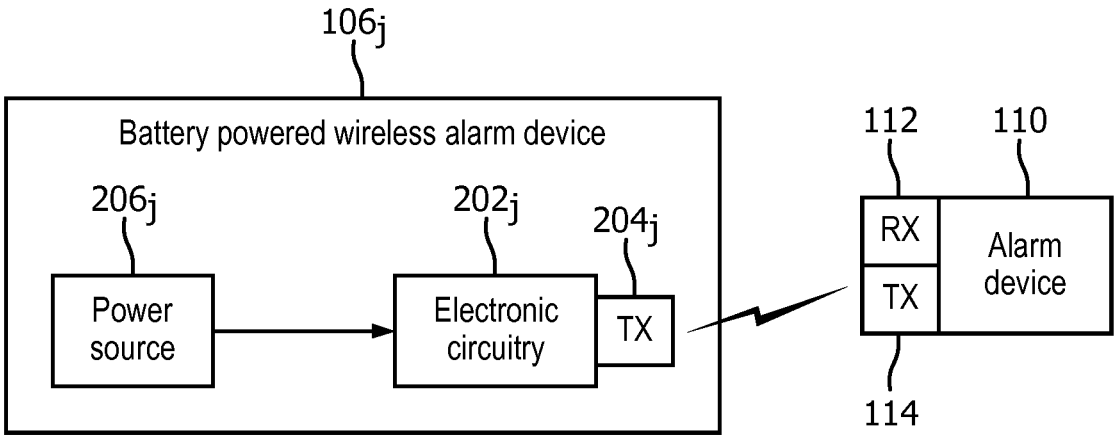
FIG. 2 (Prior art)
FIG. 2 schematically illustrates an example of the prior art battery powered wireless alert device.

The BPWA device $\mathbf{304}_j$ is similar to the BPWA device $\mathbf{106}_j$ (FIG. 2) in that it includes the electronic circuitry $\mathbf{202}_j$, the transmitter $\mathbf{204}_j$, and the power source $\mathbf{206}_j$. The BPWA device $\mathbf{304}_j$ further includes a logic circuit $\mathbf{402}_j$. The logic circuit $\mathbf{402}_j$ is configured to toggle an output logic level between two states (e.g., low and high, 1 and 0, etc.) at a predetermined rate. For this, the logic circuit $\mathbf{402}_j$ can include Transistor-Transistor Logic (TTL) and/or other logic technology. In one instance, the predetermined rate is at least once per every 90 seconds, e.g., once every 45 seconds, once every 60 seconds, etc.

The BPWAD monitor 306, includes monitoring circuitry $\mathbf{404}_j$ configured to monitor a health state of the BPWA device $\mathbf{304}_j$, a transmitter (TX) $\mathbf{406}_j$ configured to transmit a radio frequency signal to the alarm system 110, and a power source 408; configured to supply power to the BPWA device $\mathbf{304}_j$ when the power source $\mathbf{206}_j$ of the BPWA device $\mathbf{304}_j$ is unavailable. In a variation, the power source $\mathbf{408}_j$ is omitted.

In the illustrated example, the transmitter $\mathbf{406}_j$ is configured to transmit in a frequency band that is different than the frequency band of the transmitter $\mathbf{204}_j$. An example of a suitable band is from 317 MHz to 319.5 MHz. In this instance, the receiver 112 is tuned to the frequency band of the transmitter $\mathbf{204}_j$ and the receiver 308 is tuned to the frequency band of the transmitter $\mathbf{406}_j$. In another instance, the frequency band of the transmitter $\mathbf{406}_j$ is the same as that of the transmitter $\mathbf{204}_j$. From above, suitable frequency bands for the transmitter $\mathbf{204}_j$ include 896-901 MHz, Wi-Fi, and/or another FCC mandated band. In this instance, a single receiver is tuned or the two receivers 112 and 308 are tuned to the same frequency band of the transmitters $\mathbf{204}_j$ and $\mathbf{406}_j$.

The power source $\mathbf{408}_j$ in this example is a supercapacitor. In other embodiments, the power source $\mathbf{408}_j$ is a primary battery, a secondary battery, or other charge storage device. The power source $\mathbf{206}_j$ supplies charging power to the power source 408$_j$ via a charging path 410$_j$. This charging has negligible impact on the lifetime and/or charge level of the power source 206$_j$. The charging path 410$_j$ may include a protection diode or the like to isolate the power source 408$_j$ from the power source 206$_j$ so that the BPWA device 304$_j$ does not drain the power source 408$_j$. The power source 408$_j$ provides power in instances where the power source 206$_j$ fails or does not have enough charge.

The monitoring circuitry 404$_j$ includes a low power microcontroller that receives the logic level from the logic circuit 402$_j$ over a path 412$_j$. The monitoring circuitry 404$_j$ is configured to monitor the changing state of the logic level. The low power microcontroller of the monitoring circuitry 404$_j$ would have less of an impact on the lifetime and/or charge level of the power source 206$_j$ relative to increasing the status signal transmission rate. For example, where the monitoring circuitry 404$_j$ draws an average of 2 microamperes (μA) of electrical current, the total current consumption rate is 0.015 mAh+0.0002 mAh=0.0152 mAh, the battery life is 1,400 mAh/0.0152 mAh=82,352.9 hours, or 9.4 years. This represents a theoretical reduction in the lifetime of the power source 206$_j$ of 10% (10.5 years to 9.4 years), whereas increasing the status signal transmission rate of the BPWA device 106$_j$ from every 1.5 hours to every 30 seconds (as discussed in connection with FIGS. 1 and 2) would theoretically reduce the lifetime of the power source 206$_j$ by 66% (10.5 years to 3.62 years).

The monitoring circuitry 404$_j$ is further configured to invoke the transmitter 406$_j$ to transmit, on-demand, a BPWAD failure signal to the alarm system 110 in response to the logic level not changing within the predetermined rate. In this example, the BPWAD failure signal includes at least a UID for the BPWAD monitor 306$_j$. In this instance, the alarm system 110 includes a look-up table (LUT) or the like that maps BPWAD monitor UIDs to information about the BPWAD monitors such as a current location of the BPWAD monitor 306$_j$, a type of equipment of the BPWA device 304$_j$ being monitored by the BPWAD monitor 306$_j$, etc. The LUT is editable and is updated when a BPWAD monitor 306, is added or removed from the system 302.

With the configuration described herein, in one instance the BPWA device 304$_j$ transmits a status signal at a rate outside of the rate specified in the UL 1069 standard to the alarm system 110 and toggles the logic level at a rate that satisfies the rate specified in the UL 1069, and the BPWAD monitor 306$_j$ transmits the BPWAD failure signal upon detecting a failure of the BPWA device 304$_j$ via the logic level. As such, the lifetime of the power source 206$_j$ can be extended, e.g., to 10 or more years by transmitting at a rate of one hour or more, while the system 302 satisfies the UL 1069 standard with minimal additional bandwidth consumption. Furthermore, utilizing different transmission frequency bands for the BPWA device 304$_j$ and the BPWAD monitor 306$_j$ mitigates blockage of the BPWAD failure signal when the frequency band for the BPWA device 304$_j$ is not useable.

In general, with this configuration: 1) the BPWA device 304$_j$ is configured to transmit at a rate determined based on a desired lifetime of the power source 206$_j$, wherein the rate does not satisfy a pertinent standard; 2) the BPWA device 304$_j$ toggles an output logic level at a rate that satisfies the pertinent standard, and the BPWAD monitor 306, transmits a BPWAD failure signal on-demand in response to the output logic level not toggling within the toggle rate.

In FIG. 3, the MPWA devices 108$_1$, . . . , 108$_M$ do not include monitors similar to the BPWAD monitors 306$_1$, . . . , 306$_M$. In general, the MPWA devices 108$_1$, . . . , 108$_M$ are powered with mains power and not battery power and thus the transmission rate of the MPWA devices 108$_1$, . . . , 108$_M$ do not affect the lifetime of the power source of the MPWA devices 108$_1$, . . . , 108$_M$. However, in an alternative embodiment the MPWA devices 108$_1$, . . . , 108$_M$ also have monitors (i.e. MPWAD monitors). In this alternative embodiment, the MPWAD monitors would reduce RF transmission traffic and the bandwidth consumption by the MPWA devices 108$_1$, . . . , 108$_M$ and allow the MPWA devices 108$_1$, . . . , 108$_M$ to transmit at a rate outside of the UL 1069 standard, as described herein.

Figure 5:
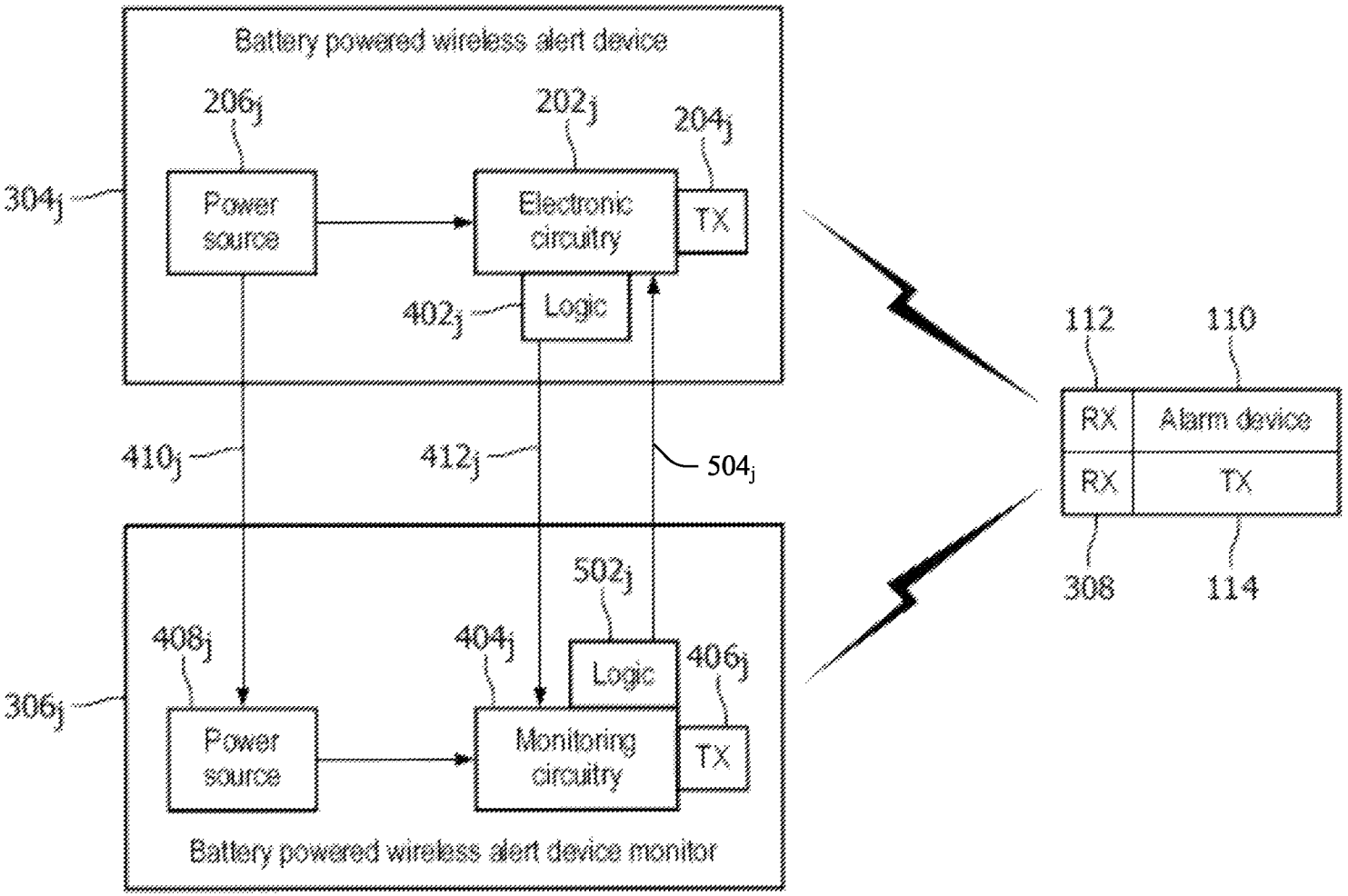
FIG. 5 schematically illustrates a variation of the battery powered wireless alert device and the battery powered wireless alert device described in connection with FIG. 4, in accordance with an aspect of an embodiment(s) herein.

FIG. 5 schematically illustrates a variation of the BPWAD monitor 306, described in connection with FIG. 4 that further includes logic circuit 502$_j$ and a path 504$_j$. The logic circuit 502$_j$ is configured to toggle a logic signal between two states at a predetermined rate, e.g., similar to the logic circuit 402$_j$. Furthermore, the electronic circuitry 202$_j$ is further configured with logic level monitoring similar to the monitoring circuitry 404$_j$ of the BPWAD monitor 306$_j$. Likewise, this feature has little effect on the lifetime of the power source 206$_j$.

In this example, the electronic circuitry 202$_j$ receives the logic level from the logic circuit 502$_j$ over the path 504$_j$. The electronic circuitry 202$_j$ is configured to monitor the changing state of the logic level. The electronic circuitry 202$_j$ is further configured to invoke the transmitter 204$_j$ to transmit, on-demand, a BPWAD monitor failure signal to the alarm system 110 in response to the logic level not changing within the predetermined rate. The BPWA monitor failure signal can be similar to the BPWA device failure signal and include a UID of the BPWAD monitor. In this embodiment, the alarm system 110 is notified when either the BPWA device 304$_j$ or the BPWAD monitor 306, fails and can then notify appropriate personnel as described herein.

In general, with this configuration: 1) the BPWA device 304$_j$ is configured to transmit a health status signal at a rate determined based on a desired lifetime of the power source 206$_j$, wherein the rate does not satisfy a pertinent standard; 2) the BPWA device 304$_j$ toggles an output logic level at a rate that satisfies the pertinent standard; 3) the BPWAD monitor 306, transmits a BPWAD failure signal on-demand in response to the output logic level not toggling within the toggle rate; 4) the BPWAD monitor 306, toggles an output logic level at the toggle rate; and 5) the BPWA device 304$_j$ transmits a BPWAD monitor failure signal on-demand in response to the output logic level not toggling within the toggle rate.

In a variation, the BPWA device 304$_j$ does not transmit the health status signal. The BPWAD monitor 306, transmits the BPWAD failure signal, on-demand, in response to the output logic level of the BPWAD device 304$_j$ not toggling within the toggle rate, and the BPWAD device 304$_j$ transmits the BPWAD monitor failure signal, on-demand, in response to the output logic level of the BPWAD monitor 306, not toggling within the toggle rate. Likewise, the alarm system 110 is notified when either the BPWA device 304$_j$ or the BPWAD monitor 306, fails and can then notify appropriate personnel as described herein.

Figure 6:
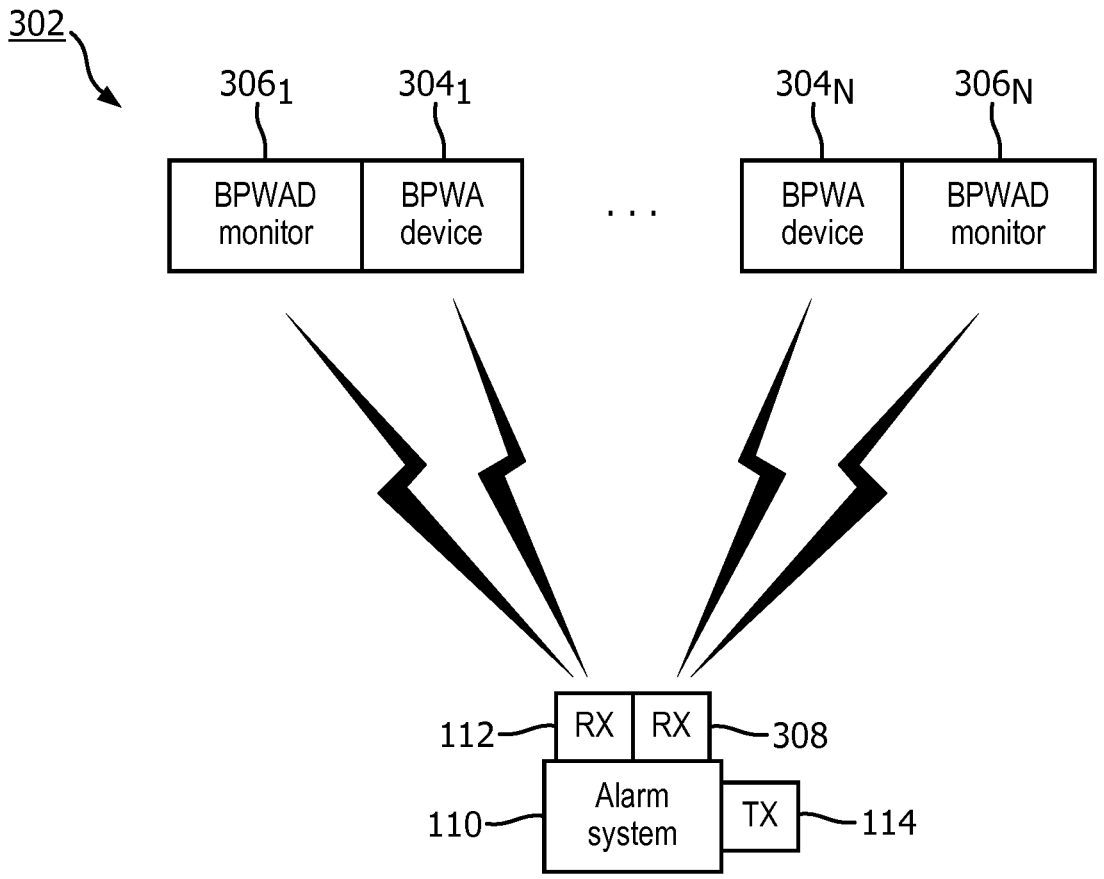
FIG. 6 schematically illustrates a variation of the alarm system described in connection with FIG. 3, in accordance with an aspect of an embodiment(s) herein.

FIG. 6 schematically illustrates a variation of the system 302 described in connection with FIG. 3. In this variation, the system 302 does not include any MPWA devices.

Figure 7:
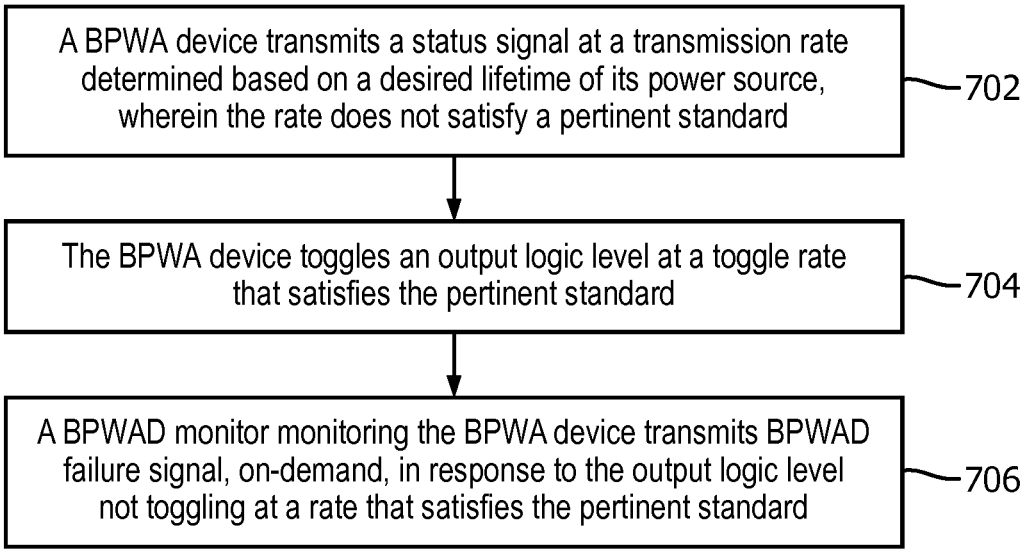
FIG. 7 illustrates an example method in accordance with an aspect of an embodiment(s) herein.

FIG. 7 illustrates an example method in accordance with an embodiment(s) herein. It is to be appreciated that the ordering of the below acts is not limiting, and other ordering is contemplated herein, including concurrent.

At 702, a BPWA device transmits a status signal at a transmission rate determined based on a desired lifetime of its power source, wherein the rate does not satisfy a pertinent standard.

At 704, the BPWA device toggles an output logic level at a toggle rate that satisfies the pertinent standard.

At 706, a BPWAD monitor monitoring the BPWA device transmits BPWAD failure signal, on-demand, in response to the output logic level not toggling at a rate that satisfies the pertinent standard.

Figure 8:
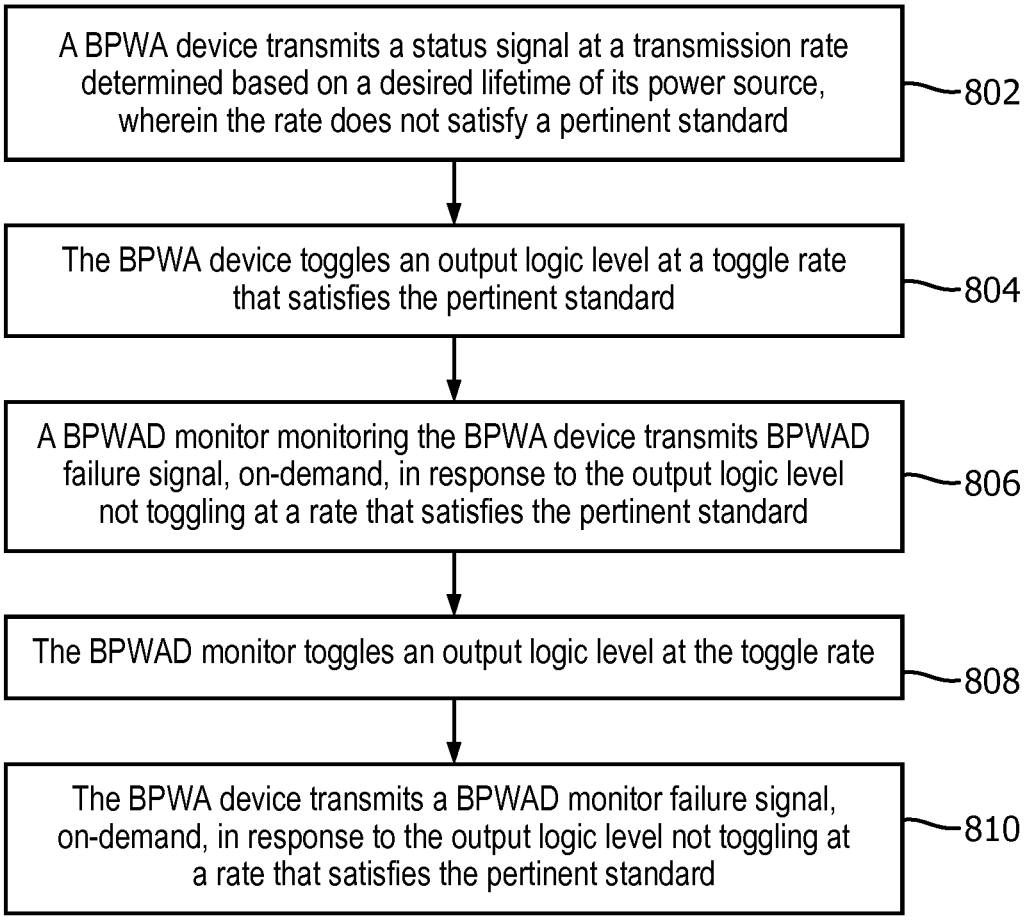
FIG. 8 illustrates another example method in accordance with an aspect of an embodiment(s) herein.

FIG. 8 illustrates an example method in accordance with an embodiment(s) herein. It is to be appreciated that the ordering of the below acts is not limiting, and other ordering is contemplated herein, including concurrent.

At 802, a BPWA device transmits a status signal at a transmission rate determined based on a desired lifetime of its power source, wherein the rate does not satisfy a pertinent standard.

At 804, the BPWA device toggles an output logic level at a toggle rate that satisfies the pertinent standard.

At 806, a BPWAD monitor monitoring the BPWA device transmits BPWAD failure signal, on-demand, in response to the output logic level not toggling at a rate that satisfies the pertinent standard.

At 808, the BPWAD monitor toggles an output logic level at the toggle rate.

At 810, the BPWA device transmits a BPWAD monitor failure signal, on-demand, in response to the output logic level not toggling at a rate that satisfies the pertinent standard.

The method(s) described herein may be implemented by way of computer readable instructions, encoded or embedded on computer readable storage medium (which excludes transitory medium), which, when executed by a computer processor(s) (e.g., CPU, microprocessor, etc.), cause the processor(s) to carry out acts described herein. Additionally, or alternatively, at least one of the computer readable instructions is carried by a signal, carrier wave or other transitory medium, which is not computer readable storage medium.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A system, comprising:

a battery powered wireless alert device, comprising:

electronic circuitry;

a transmitter configured to transmit a signal at a predetermined first rate to an alarm device;

a logic circuit configured to generate an output signal including a logic level at a predetermined second rate, wherein the first rate is lower than the second rate; and a power source configured to supply power to at least the electronic circuitry and the logic circuit; and a battery powered wireless alert device monitor comprising:

monitoring circuitry configured to monitor a health state of the battery powered wireless alert device based on the logic level of the output signal of the logic circuit; and a transmitter configured to transmit a battery powered wireless alert device failure signal, on-demand, to the alarm device in response to the monitoring circuitry determining the logic level fails to satisfy predetermined criteria.

2. The system of claim 1, wherein the transmitter of the battery powered wireless alert device is configured to transmit in a first frequency band and the transmitter of the battery powered wireless alert device monitor is configured to transmit in a second different frequency band.

3. The system of claim 1, wherein the logic level toggles between at least two levels, and the predetermined criteria includes failure of the output signal to toggle between the at least two levels.

4. The system of claim 1, wherein the signal transmitted by the transmitter of the battery powered wireless alert device includes a health status signal indicative of a health state of the battery powered wireless alert device.

5. The system of claim 3, wherein the first rate fails to satisfy a rate standard, and the second rate satisfies the rate standard.

6. The system of claim 1, wherein the battery powered wireless alert device monitor further includes a rechargeable power source, and the power source of the battery powered wireless alert device is configured to supply charging power to the rechargeable power source of the device monitor.

7. The system of claim 1, wherein the battery powered wireless alert device monitor further includes: a logic circuit configured to generate an output signal at the predetermined second rate; and wherein the electronic circuitry is further configured to monitor a health state of the battery powered wireless alert device monitor based on the logic level, the signal transmitted by the transmitter of the battery powered wireless alert device includes a battery powered wireless alert device monitor failure signal, and the transmitter of the battery powered wireless alert device is configured to transmit the signal, on-demand, to the alarm device in response to the logic level failing to satisfy the predetermined criteria, wherein the output signal includes a logic level that toggles between at least two levels.

8. The system of claim 1, wherein the transmitter of the battery powered wireless alert device and the transmitter of the battery powered wireless alert device monitor are configured to transmit in a same frequency band.

9. A method, comprising:

transmitting, with a transmitter of a battery powered wireless alert device, a signal at a predetermined first rate to an alarm device;

toggling, with a logic circuit of the battery powered wireless alert device, an output logic level between two logic levels at a predetermined second rate;

monitoring, with monitoring circuitry of a battery powered wireless alert device monitor, the toggling of the output logic level at the predetermined second rate, wherein the second rate is higher than the first rate; and transmitting, with a transmitter of the battery powered wireless alert device monitor, a battery powered wireless alert device monitor failure signal, on-demand, in response to detecting the output logic level is not toggling at the predetermined second rate.

10. The method of claim 9, further comprising:

charging, with a battery of the battery powered wireless alert device, a supercapacitor of the battery powered wireless alert device monitor.

11. The method of claim 9, further comprising:

toggling, with a logic circuit of the battery powered wireless alert device monitor, an output logic level between the two logic levels;

monitoring, with electronic circuitry of the battery powered wireless alert device, the toggling of the output logic level at the predetermined second rate; and transmitting, with the transmitter of the battery powered wireless alert device, the signal, on-demand, in response to detecting the output logic level is not toggling at the predetermined second rate, wherein the signal includes a battery powered wireless alert device monitor failure signal.

12. A method, comprising:

receiving, at an alarm device, a signal transmitted with a transmitter of a battery powered wireless alert device at a predetermined first rate;

receiving, at the alarm device, a battery powered wireless alert device failure signal transmitted with a transmitter of a battery powered wireless alert monitor device within a predetermined time period from detection by the battery powered wireless alert monitor device that the battery powered wireless alert device failed to toggle a logic level between two states within a predetermined second rate; and transmitting, with the alarm device, a notification signal indicating the battery powered wireless alert device failed.

13. The method of claim 12, further comprising:

reading, with the alarm device, a unique identification of the battery powered wireless alert device monitor from the battery powered wireless alert device failure signal;

mapping, with the alarm device, the unique identification of the battery powered wireless alert device monitor to at least a location of the device monitor; and transmitting, with a transmitter of the alarm device, the location with the notification signal.

14. The method of claim 12, wherein the signal includes a battery powered wireless alert device monitor failure signal, and further comprising:

receiving, at the alarm device, the signal transmitted with the transmitter of the battery powered wireless alert device within a predetermined time period from detection by the battery powered wireless alert device that the battery powered wireless alert device monitor failed to toggle a logic level between two states within the predetermined second rate; and transmitting, with the alarm device, a notification signal indicating the device monitor failed.

15. The method of claim 13, further comprising:

reading, with the alarm device, a unique identification of the battery powered wireless alert device from the battery powered wireless alert device monitor failure signal;

mapping, with the alarm device, the unique identification of the battery powered wireless alert device to at least a location of the battery powered wireless alert device; and transmitting, with the transmitter of the alarm device, the location with the notification signal.

16. The system of claim 5, wherein the first rate is less than once per ninety seconds and the second rate is greater than or equal to once per ninety seconds.

17. The system of claim 7, wherein the logic level toggles between at least two levels, and the predetermined criteria includes failure of the output signal to toggle between the at least two levels.

18. The system of claim 9, wherein the signal includes a health status signal that indicates a health state of the battery powered wireless alert device, the transmitter of the battery powered wireless alert device transmits in a first frequency band, and the transmitter of the battery powered wireless alert device monitor transmits in a second different frequency band.

19. The method of claim 10, further comprising:

supplying power from the supercapacitor to the battery powered wireless alert device in response to the battery being unable to supply operating power to the battery powered wireless alert device.

20. The method of claim 12, wherein the signal includes a health status signal indicative of a health status of the battery powered wireless alert device and is received in a first frequency band, and the battery powered wireless alert device failure signal is received in a second different frequency band.

* * * * *